United States Patent [19]

Horvath et al.

[11] 4,146,093

[45] Mar. 27, 1979

[54] LAYER-SEPARATING DEVICE HYDRAULICALLY ANCHORABLE IN A WELL CASING

[75] Inventors: Robert Horváth; Rudolf László; Géza Szabó, all of Nagykanizsa, Hungary

[73] Assignees: Köolaj-es Földgazbanyaszati Ipari Kutato Laboratorium; Orszaagos Köolaj-es Gaazipari Tröszt, both of Budapest, Hungary

[21] Appl. No.: 761,407

[22] Filed: Jan. 21, 1977

[51] Int. Cl.[2] ..... E21B 33/128

[52] U.S. Cl. ..... 166/120; 166/134

[58] Field of Search ..... 166/297, 301, 315, 98, 166/99, 120, 134; 294/86.34

[56] References Cited

U.S. PATENT DOCUMENTS

| | | | |
|---|---|---|---|
| Re. 28,641 | 12/1975 | Chenoweth | 166/120 |
| 3,318,384 | 5/1967 | Brown | 166/120 |
| 3,352,593 | 11/1967 | Webb | 294/86.34 |
| 3,391,740 | 7/1968 | Edwards | 166/120 |

*Primary Examiner*—Ernest R. Purser
*Attorney, Agent, or Firm*—Karl F. Ross

[57] ABSTRACT

A well packer or layer-separating device adapted to seal off a stringer against a deep-well casing comprises a polished sleeve against a shoulder at the upper end of which a sealing ring is compressible to seal the device against the inner wall of the casing. Below this seal there are provided two rows of keys engageable with the casing to hold the device in place. The upper row is forced outwardly by a downwardly divergent wedging member coupled to an anchoring sleeve which is held by an upper locking device against the polished sleeve. The lower end of the polished sleeve is formed as a piston which cooperates with a cylinder driving an upwardly converging wedge member beneath the lower row of keys and, via shear screws causing the anchor sleeve to ride upwardly.

3 Claims, 1 Drawing Figure

LAYER-SEPARATING DEVICE HYDRAULICALLY ANCHORABLE IN A WELL CASING

FIELD OF THE INVENTION

The invention relates to a layer-separating device to be anchored hydraulically in a casing provided with double-row, double-acting key means, as well as a polished sleeve, which can be removed by partial destruction, the packer matching this sleeve and being removable from the same. This layer-separating device is suitable for the separation of opened layers lying beneath each other in deep wells which are provided with steel casings, even at high differential pressures and diverse thermal conditions of the layer.

The device according to the invention — due to the durability of the sealing between the polished sleeve and the casing and other advantages — has been widely used, primarly in the field of crude oil and natural gas exploitation, as basic equipment for selective bore constructions.

The device arranged above high — pressure layers ensures with a high efficiency the corrosion — and pressure tightness of the stand of pipe; by suitable manipulations it becomes possible to plug the layers within the layer-separating device, thus enabling pulling out the string without filling the bore with a liquid.

BACKGROUND OF THE INVENTION

In the field of crude oil expoloitation permanent layer-separating devices without a releasing device are known; these devices can be removed from the casing only by destruction.

Some of these devices can be anchored by means of a so-called "hydraulical landing device" forming a separate assembly unit; in this case efficient setting can be achieved only when beside hydraulic forces a mechanical pulling force is also effective, involving the disadvantageous displacement of the tubing.

As far as we know, the most significant permanent layer-separating devices which can be removed from the casing by destruction, have been produced in USA (Baker — F,FA,D,DA types; Otis-PERMA-DRILL, as well as the types PD-1,HSP-1 produced by the company CAMCO).

A common feature of the devices enumerated above lies in that for taking the alternating, bidirectional hydraulical and mechanical loads during operation, beneath and above the rubber sealing there is a double-rowed key system and removal from the casing can be performed by the complete destruction of the device only, i.e. by destruction of a key system.

The drawback of such devices lies in that during cutting operation the equipment unscrews and after having removed the upper keyrow, it often slips, thus retrieval becomes difficult and in several cases can be performed by only by a chancy fishing job.

OBJECT OF THE INVENTION

The object of the invention is to provide a permanent layer-separating device to be set of anchored hydraulically, forming an integral group with the anchoring hydraulics, where anchoring or setting does not require removal of the string and the polished sleeve can be removed from the casing by a partial destructive operation.

By the structural arrangement of the layer-separating device according to the invention the parts neither unscrew nor slip during the cutting operation and after having removed the contaminations deposited and cut a defined element of the equipment, other parts of the device can be retrieved from the casing by the use of a conventional tool.

The permanent layer-separating device according to the invention is provided with a double-row, double-acting key system and with suitable rubber sealings, the device being suitable for hydraulic setting. The device is characterized in that it contains a polished sleeve assembled of several parts by means of screwthreads, furthermore there is a packer matching to this sleeve and provided with suitable rubber seal and mounted on the string of pipe in a removable way. On the outer surface of the polished sleeve the rubber sealings and under the sealing elements the upper and the lower keys are arranged, a key guide and a spacer ring serve for guiding the keys. On the key guide a pressure sleeve is fixed by means of threaded pins, the inner sleeve being provided with a ribbed guide. The lower key is supported from beneath by a conical cylinder cover, furthermore the equipment incorporates a hydraulic cylinder serving for the operation of the sealing and fixing elements, as well as as anchoring cylinder fixed to the key guide and the spacing ring by shear screws; the upper and lower locking devices serve for stabilizing the compressed state, furthermore in the polished sleeve there is a sealed transition element fixed to the sleeve through the rubble damming device by means of screwthreads.

BRIEF DESCRIPTION OF THE DRAWING

The invention will be described in details with the aid of the the drawing enclosed, where the sole FIGURE is a diagrammatic partial cross section of the layer-separating device according to the invention.

SPECIFIC DESCRIPTION

Figure 1:
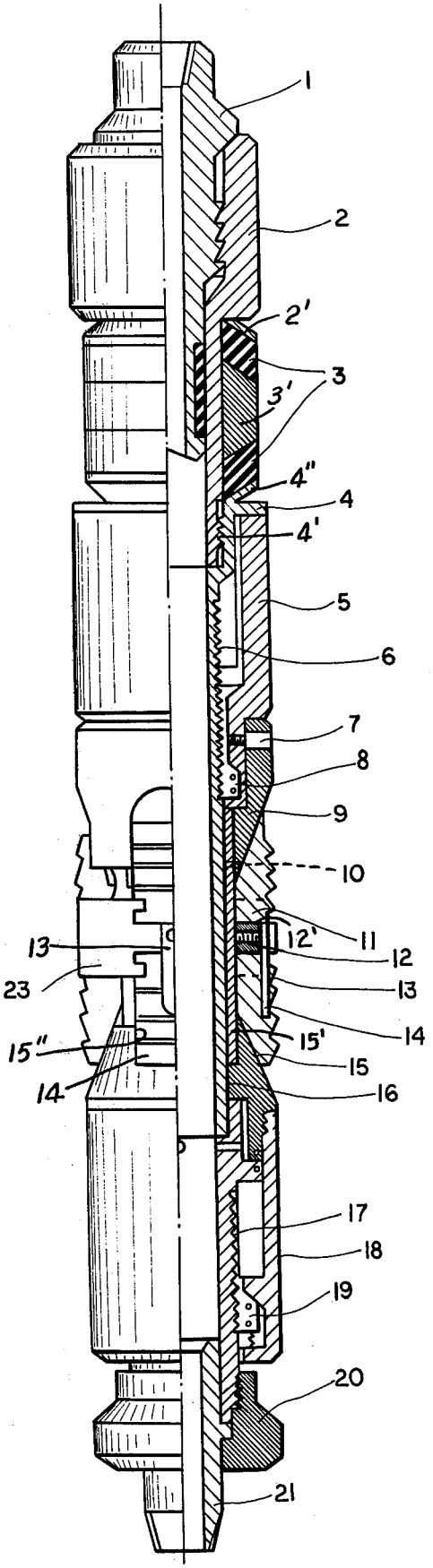

The tubing packer 1 consisting of several elements is connected to the upper sleeve 2 of the layer-separating device by a divided counter-clockwise thread. A rubber seal 3 serves for sealing the sleeve 2 and the casing space against the casing (not shown); the sealing element 3, 4 is supported from beneath by the pressure sleeve 5. The inner surface of the pressure sleeve 5 is guided by ribs on the outer surface of a lower sleeve 6, the ribbed connection prevents undesired separation of the upper sleeve 2 and of the lower sleeve 6 which are connected to by a screw-thread. The seals are pressed against the support 3' by relative rotation of members 2 and 4 which are connected by a thread 4' to press the shoulders 2' and 4'' against the seals 3. The latter are thus forced outwardly.

A key guide 9 is connected to the lower end of the pressure sleeve 5 by means of the threaded pins 7; in T-shaped grooves of this key-guide there are to be found upper keys 11 fixing the layer-separating device against the forces acting from above. The key guide 9 is fixed to the landing setting sleeve 15 by means of the shear screws 10 one seam in broken lines serving for setting the rubber seals 3. The upper key 11 and the lower key 14 are supported by the spacer ring 23 and held together by the T-shaped grooves, the spacer ring being fixed to the landing sleeve 15 by means of shear screws 12 serving for setting the upper keys 11. The shear screw 12 is threaded into a sleeve 15' forming an extension of the landing sleeve 15 and is surrounded by a bushing 12'. The shear screws 10 also engage this thin sleeve 15'. The lower keys 14 are guided in slots 15'' in the landing sleeve 15 as can be seen from the left-hand side of the drawing and are analogous to the upper keys 11 but are oppositely effective.

The lower keys 14 fix the layer-separating device against the forces acting from below. These keys are fitted to a conical cylinder cover 16 and their positions are fixed by the leaf springs 13.

The lower sleeve 6 and the piston stub 17 are connected by a screw thread. On the surface of stub the hydraulic cylinder 18 is arranged to serve for setting the fixing and sealing elements, the cylinder being closed by the cylinder cover 16. The position of the cylinder after displacement is fixed on the piston stub 17 by the lower locking device 19 with a buttress thread.

The transition element 21 is connected to the piston stub 17 through the rubble damming device 20 by a screw thread and hydraulic sealing is effected by the O-rings.

The layer-separating device according to the invention functions as follows:

Landing process

The known supplementary elements are connected to the layer-separating device; the circulation joint is mounted above the device, the landing ball-valve is screwed onto the transition element or a landing valve can be adjustably secured otherwise to this element.

The unit assembled as described above is lowered to the depth desired. After the lower end is closed, a hydraulic or pneumatic overpressure is established in the string and the inner space of the layer-separating device.

Under the applied influence of the pressure the cylinder 18 and the cylinder cover 16 are displaced upwardly to apply an anchoring force on the key guide 9 through the landing sleeve 15; the same force is transmitted to the shear screws 10 and the pressure sleeve 5. The seals are thus compressed and pressed against the wall of the casing, in a sealing position.

The screws 10 are sheared at a certain pressure and since the upper locking device 8 follows the upward movement it becomes fixed on the lower sleeve 6 and prevents backslide of the rubber seals.

Maintaining and increasing the anchoring force exerts influence on the spacer ring 23 through the landing sleeve 15 and the shear screws 12. As a consequence the upper keys 11 slide on the key guide 9 outwards, they butt on the wall of the casing and there become fixed.

At a predetermined value of the anchoring pressure the screws 12 are sheared, the conical (tapered) cylinder cover 16 sliding beneath the lower keys 14 and presses them against pressing the keys to the wall of the casing.

After having reached its limiting value, the pressure is relieved, the lower locking device 19 sizes the piston stub 17, and the state becomes stabilized. The double-acting keysystem protects the layer-separating device against bi-directional stresses.

Partial cutting and pulling out of the layer-separating device takes place, as follows:

After having been turned to the right and unscrewed from the layer-separating device, the packer 1 of the tubing is pulled out without any difficulty. A milling machine with a single hard metal tip is connected to the string.

The device is rested on the upper sleeve 2 of the layer-separating device and milling of the upper sleeve 2 is begun/load: 2–3 Mp, number of revolutions: 40–60 rpm.; the sleeve can be cut easily, in spite of the fact that it is made of a high-strength material. Milling of the sleeve is continued until chips of the rubber seal 3 appear in the circulating liquid, then milling may be finished.

By the cutting operation and circulation the sand and contaminant deposited above the layer-separating device are partly removed, and the upper support of the sealing element is removed by partial or total destruction.

Pulling out of the lower part of the layer-separating device takes place, as follows:

Because of the structural arrangement of the layer-separating device during cutting of the upper sleeve 2 and the rubber seals 3 the elements held by the upper and lower key 11,14 neither turn off nor slide back but remain in a fixed state.

After milling the lower part can be pulled out by means of conventional tools, usual in operative practice, e.g. a casing spear or a threaded mandrel.

The retrieving device is first fixed either in the upper sleeve 2 or in the lower sleeve 6, both sleeves being prevented from turning off by the pressure sleeve 5, the threaded pins 7, the key guide 9 and the upper key 11.

Hereinafter the retrieving device is lowered under an appropriate load. Under the influence of this pressive force the lower sleeve 6 and the piston stub 17 are performing a movement, the head-part of said piston stub comes to rest on the endplate of the cylinder 18. After having pressed the said plate downwards, it pulls out the conical cylinder cover 16 from under the lower plate of the keys 14 so that the keys are not supported anymore from below. When displacement has been finished, the head-part of the lower sleeve 6 is butting on the inner shoulder of the pressure sleeve 5 and on the key guide fixed onto the casing by means of the upper keys 11.

After having performed the operations enumerated the pulling device is lifted. Under the influence of the pulling force the upper locking device 8 comes to abut the lower conical end of the pressure sleeve 5; the pulling force is effective through the threaded pins 7 on the key guide 9, pulling out the same from beneath the upper keys 11; the fixing elements 11 are released from the wall of the casing and under influence of the leaf springs 13 they return into the guide-grooves of the key guide 9.

The lower part of the layer-seperating device according to the invention, released as described above, can be easily pulled out from the casing.

As may be seen, the layer-separating device according to the invention is of simple construction and anchoring takes place hydraulically, so that movement of the string is not imperative; the structural arrangement ensures appropriate fixing and sealing against the bi-directional hydraulic and mechanical stresses. Withdrawal from the casing can be performed in a safe way and compared to any other equipment of similar type. Its use is most advantageous, since when cutting the packing sleeve and the sealing element the equipment neither turns off nor slides back and after having milled away elements enumerated, removal from the casing can be easily performed.

A further advantage lies in that by positioning the fixing elements beneath the rubber sealing, cutting through of a high-strength row of keys can be omitted, simultaneously, shortening the duration of removal.

What we claim is:

1. A device for separating strata layers in a well casing, comprising:

an elongated internal sleeve formed at its upper end with a shoulder and at its lower end with a piston;

a sealing ring surrounding said internal sleeve and abutting against said shoulder, said sealing ring being compressible axially to sealingly engage the interior of said case;

a pressure sleeve axially shiftable on said inner sleeve below said ring and adapted to bear axially thereon, said pressure sleeve and said inner sleeve being formed with mutually engaging axially extending ribs limiting relative rotation of said sleeve;

a downwardly converging key guide connected to said pressure sleeve by laterally extending threaded pins;

a setting sleeve axially shiftable on said inner sleeve and operatively bearing upon said pressure sleeve axially, said setting sleeve being formed with a spacer ring connected to said setting sleeve by shear screws, and upper and lower rows of keys mounted on said spacer ring whereby said upper row cooperates with said key guide;

a setting cylinder surrounding said piston and formed with an upwardly converging cylinder cover engaging said setting sleeve and cooperating with said lower row; and upper locking means between said pressure sleeve and said inner sleeve for locking said pressure sleeve against said inner sleeve in a compressed condition of said ring, and lower locking means between said cylinder and said piston for locking same in a maximum upward position of said cylinder cover relative to said piston, said cylinder being pressurizable to initially displace said pressure sleeve axially and compress said sealing ring into engagement with said casing and thereafter to shear said shear screws and effect outward displacement of said upper and lower rows of keys into engagement with said casing.

2. The device defined in claim 1, further comprising spring means biasing said keys inwardly.

3. The device defined in claim 1 wherein said inner sleeve is formed with an upper portion adapted to be milled away to relieve said sealing ring, said upper portion threadingly engaging an intermediate portion of said inner sleeve, said intermediate portion of said inner sleeve threadingly engaging a lower portion thereof forming said piston, said upper, intermediate and lower portions defining a continuous bore through said device.

* * * * *